US005501254A

United States Patent [19]

Björklund

[11] Patent Number: 5,501,254

[45] Date of Patent: Mar. 26, 1996

[54] APPARATUS FOR FILLING A SACK WITH A FLOWABLE MATERIAL

[75] Inventor: Jan-Peter Björklund, Pargas, Finland

[73] Assignee: Optiroc Oy Ab, Helsinki, Finland

[21] Appl. No.: 211,370

[22] PCT Filed: Oct. 2, 1992

[86] PCT No.: PCT/FI92/00267

§ 371 Date: Aug. 8, 1994

§ 102(e) Date: Aug. 8, 1994

[87] PCT Pub. No.: WO93/07056

PCT Pub. Date: Apr. 15, 1993

[30] Foreign Application Priority Data

Oct. 4, 1991 [FI] Finland ..... 914687

[51] Int. Cl.[6] ..... B65B 31/04

[52] U.S. Cl. ..... 141/65; 141/71; 141/114; 141/315

[58] Field of Search ..... 141/65, 10, 12, 141/71, 114, 291, 290, 313, 314, 315, 317

[56] References Cited

U.S. PATENT DOCUMENTS

| | | | |
|---|---|---|---|
| 3,260,285 | 7/1966 | Vogt | 141/12 |
| 3,586,066 | 5/1969 | Brown | 141/5 |
| 3,707,172 | 12/1972 | Obara | 141/317 |
| 3,785,410 | 1/1974 | Carter | 141/10 |
| 3,788,368 | 1/1974 | Geng et al. | 141/67 |
| 4,579,154 | 4/1986 | Müller | 141/114 |
| 5,244,019 | 9/1993 | Derby | 141/65 |
| 5,275,215 | 1/1994 | Derby | 141/65 |

FOREIGN PATENT DOCUMENTS

| | | |
|---|---|---|
| 417675 | 3/1991 | European Pat. Off. . |
| 6704 | 9/1984 | Finland . |
| 2848505 | 5/1980 | Germany . |
| 2138380 | 10/1984 | United Kingdom . |

*Primary Examiner*—Henry J. Recla
*Assistant Examiner*—Steven O. Douglas
*Attorney, Agent, or Firm*—Scully, Scott, Murphy & Presser

[57] ABSTRACT

An apparatus for filling a sack with a flowable material, comprising a container having an inlet and an outlet and a sack holder to fasten the sack to be filled to the outlet of the container. The object of the invention is to provide a new apparatus for effectively filling a sack with a flowable material, eliminating the drawbacks of the known apparatuses. This is achieved by making the cross-section of the container (1) at least essentially correspond to the cross-section of the sack (5) in a filled condition; by making the wall (7, 8) of the container (1) enclosing the flowable material at least to an essential part permeable to air; by arranging means (13, 14) to suck air out of the flowable material through the air permeable wall (7, 8); and by arranging means (15, 16) close to the sack holder (4) below the outlet of the container to keep the sack closed during the suction of the air, with the exception of the mouth (6) of the sack fastened to the outlet of the container, and to open the sack to receive the flowable material after completed suction of the air.

7 Claims, 1 Drawing Sheet

APPARATUS FOR FILLING A SACK WITH A FLOWABLE MATERIAL

BACKGROUND OF THE INVENTION

1. Field of the Invention

The present invention relates to an apparatus for filling a sack with a flowable material, comprising a container having an inlet and an outlet and a sack holder to fasten the sack to be filled to the outlet of the container.

When a flowable material such as putty or jointing compounds or even cement is packed into sacks, the material is to be packed as tightly as possible, i.e. the material should contain as little air as possible. Before packing, most flowable materials contain a moderately large amount of air.

2. Discussion of the Prior Art

In most prior art methods the flowable material is poured into a sack, whereafter the sack is set vibrating. This is ineffective, especially if the sack is impermeable to air as is often the case.

It is also known to use a generally funnel-shaped precontainer or intermediate container into which the flowable material is first fed and to the outlet of which the sack to be filled is fastened. The flowable material in the container is deaerated by sticking a deaeration probe into the material. A drawback is that it is difficult to make the material flow once the air has been removed. In addition, the probe makes a hole filled with air and when the material settles, the air in the hole draws into the material. A similar probe has also been positioned in a filled sack but the probe then requires space and since the surface of the probe is rather small, a long deaeration time is needed. A deaeration probe of this kind is also apt to be blocked by the flowable material around it.

SUMMARY OF THE INVENTION

The object of the invention is to provide a new apparatus for effectively filling a sack with a flowable material, eliminating the drawbacks of the known apparatuses.

The apparatus according to the invention is primarily characterised in that

- the cross-section of the container at least essentially corresponds to the cross-section of the sack in a filled condition,
- the wall of the container enclosing the flowable material is at least to an essential part permeable to air,
- means are arranged to suck air out of the flowable material through the air permeable wall, and
- close to the sack holder below the outlet of the container are arranged means to keep the sack closed during the suction of the air, with the exception of the mouth of the sack fastened to the outlet of the container, and to open the sack to receive the flowable material after completed suction of the air.

The wall of the container enclosing the flowable material can be advantageously made of porous sheet metal sold under the name DYNAPORE®.

Advantageously, the wall of the container enclosing the flowable material is surrounded by a housing connected to a vacuum source. Thus the container has two walls, the inner wall being porous.

After deaeration the suction is stopped and the flowable material is allowed to fall into the sack. It is suggested that to ensure the fall of the material the porous inner wall of the container should be provided with a small clearance. Alternatively, or in addition, a pressure stroke can be used to ensure that the flowable material becomes totally detached from the inner wall of the container. In most cases the inner elasticity of the compacted flowable material is adequate to loosen the material from the inner wall of the container, whereby the material falls into the sack like a stone.

Deaeration is effective because of the large evacuation surface. The deaerated, compacted flowable material has approximately the same form as the sack in its final, filled condition, and since the flowable material opens the sack on falling, no air pocket is formed at the bottom of the sack.

The outlet of the container may be open, whereby the closed sack supported by the closing means below the mouth of the sack carries the flowable material during the suction of the air.

Alternatively, the outlet of the container may be provided with a two-part pivot plate which advantageously has a generally V-shaped form when seen from the end in a closed position, the mouth of the sack being fastened either to the arms of the V or with a slide plate.

BRIEF DESCRIPTION OF THE DRAWINGS

In the following the invention will be described with reference to the embodiment presented schematically in the attached drawing, wherein.

DETAILED DESCRIPTION OF THE PREFERRED EMBODIMENT

Figure 1:
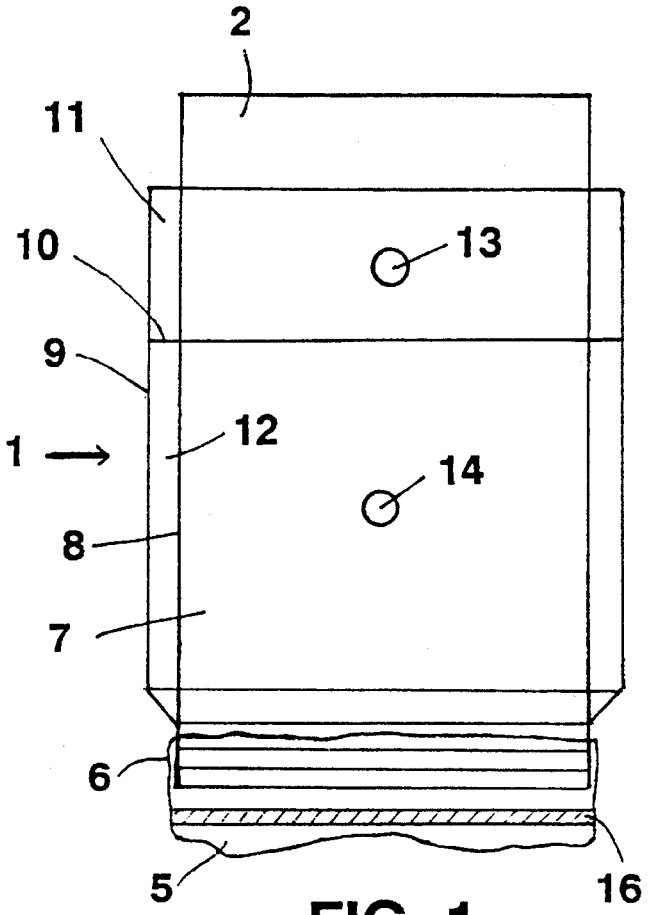
FIG. 1 shows the apparatus from the longitudinal side.

By the reference number 1 is indicated in the drawing a temporary container for flowable material with an inlet 2 at the top and an outlet 3 at the bottom. At the the outlet 3 is arranged a sack holder 4 for closing a mouth 6 of a sack 5.

The container 1 has two walls: an inner porous i.e. air permeable wall enclosing the flowable material, longitudinal sides of the wall being indicated by the number 7 and end sides by 8, and an outer wall or housing 9. The space between the inner wall 7, 8 and the outer wall 9 is divided vertically by means of an intermediate wall 10 into two separate compartments 11 and 12 having connections 13 and 14 to a vacuum source which is not shown in the drawing.

Below the outlet 3 of the container 1, open in the embodiment of the drawing, are arranged closing means 15, 16, which in the position shown in FIG. 2 keep the sack 5 closed below the mouth 6 of the sack fastened to the outlet 3 of the container, whereby the sack 5 supported by the means 15, 16 can carry the flowable material in the container 1. The reference number 15 stands for e.g. hydraulically or pneumatically driven arms, and the reference numeral 16 stands for e.g. bars.

Figure 2:
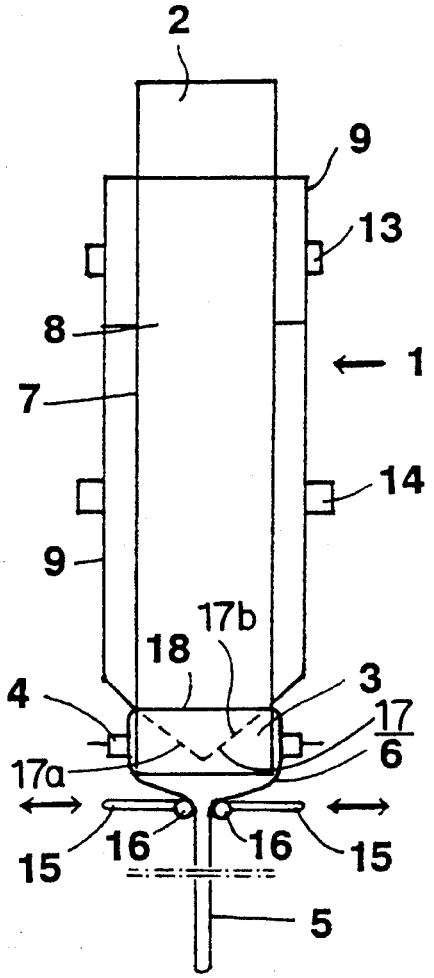
FIG. 2 shows the apparatus from the end side.
Figure 3:
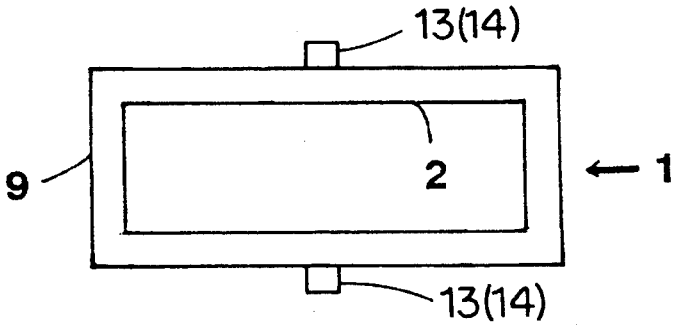
FIG. 3 shows the apparatus from the above.

Instead of being open the outlet 3 may be provided with a two-part pivot plate 17 mounted on the longitudinal sides of the container, the pivot plate suitably having a generally V-shaped form when seen from the end in a closed position, the upper end of the mouth 6 of the sack 5 being fastened to the arms 17*a*, 17*b* of the V, such a two-part pivot plate being indicated in FIG. 2 with dashed lines 17*a* and 17*b*. Alternatively, a conventional slide plate 20 can be arranged on the level of line 18 in FIG. 2.

Through the possibly funnel-shaped inlet 2, a dose of flowable material containing a moderately large amount of air is fed into the container 1. The flowable material is supposed to reach above the suction connections 13 in the upper compartment 11 between the inner and outer walls of the container.

Evacuation of air from the flowable material through the porous inner wall 7, 8, the compartments 11 and 12, and the connections 13 and 14 is started, possibly together with vibration of the container 1. As the air content of the flowable material decreases, the surface of the material may sink so much that the upper suction connections 13 are exposed, whereby continuous effective evacuation through the lower suction connections 14 is ensured by the separation of the lower compartment 12 from the upper compartment 11 by means of the intermediate wall 10.

When the deaeration has been completed, the suction is stopped and the closing means 15, 16 are released, whereby all the compacted flowable material falls into the sack 5 in one lump when the sack is opened. The cross-section of the container 1 corresponds to the cross-section of the sack 5 in a filled condition.

I claim:

1. An apparatus for filling a sack with a flowable material, comprising a container having an inlet and an outlet and a sack holder to fasten the sack to be filled to the outlet of the container, the container having a wall for enclosing the flowable material, said wall being constituted from a material permeable to air, means for aspirating air out of the flowable material through the container wall, the wall of the container defining a transverse cross-sectional area corresponding to the transverse cross-sectional area of the sack in a filled condition of said sack with flowable material, means adjacent said sack holder below the outlet of the container for maintaining a portion of the sack closed to the flow of air during the aspiration of air from said container, with the exception of the mouth of the sack which is sealed to the outlet of the container, and for opening of the sack to receive the flowable material in a single charge after completed aspiration of air.

2. An apparatus for filling a sack with a flowable material, comprising a container having an inlet and an outlet and a sack holder to fasten the sack to be filled to the outlet of the container, the container having a wall for enclosing the flowable material, said wall being constituted from a material permeable to air, means for aspirating air out of the flowable material through the container wall, the wall of the container defining a transverse cross-sectional area corresponding to the transverse cross-sectional area of the sack in a filled condition of said sack with flowable material, means adjacent said sack holder below the outlet of the container for maintaining a portion of the sack closed to the flow of air during the aspiration of air from said container, with the exception of the mouth of the sack which is sealed to the outlet of the container, and for opening of the sack to receive the flowable material in a single charge after completed aspiration of air;

the outlet of the container comprising a two-part pivotable plate structure having a generally V-shape in a closed position thereof, the mouth of the sack being fastened to each plate of the V-shaped plate structure.

3. An apparatus according to claim 1 or 2, wherein the wall of the container enclosing the flowable material is constituted of porous sheet metal permeable to air.

4. An apparatus according to claim 1 or 2, wherein the wall of the container enclosing the flowable material is surrounded by a housing of an air-impermeable wall structure with connections to a vacuum source for aspirating said air; said air-impermeable wall structure defining an encompassing space with said container wall.

5. An apparatus according to claim 4, wherein a position is located in the space between the wall structure of the housing and the wall of the container enclosing the flowable material for vertically dividing said space into separate upper and lower compartments.

6. An apparatus according to claim 1 or 2, wherein upon the outlet of the container being open, the closed sack is supported by the sack closing means below the mouth of the sack during the aspiration of air.

7. An apparatus according to claim 1, wherein the outlet of the container is provided with a slide plate.

* * * * *